US007304422B2

(12) United States Patent
Cho et al.

(10) Patent No.: US 7,304,422 B2
(45) Date of Patent: Dec. 4, 2007

(54) GLASS STRUCTURE OF CATHODE RAY TUBE

(75) Inventors: Hyun Shik Cho, Ulsankwangyuk-si (KR); Jae Seung Baek, Daegukwangyuk-si (KR)

(73) Assignee: LG.Philips Displays Korea Co., Ltd., Gumi-Si (KR)

( * ) Notice: Subject to any disclaimer, the term of this patent is extended or adjusted under 35 U.S.C. 154(b) by 7 days.

(21) Appl. No.: 10/772,358

(22) Filed: Feb. 6, 2004

(65) Prior Publication Data

US 2004/0222731 A1 Nov. 11, 2004

(30) Foreign Application Priority Data

Feb. 7, 2003 (KR) ..... 10-2003-0007917

(51) Int. Cl.
*H01J 29/86* (2006.01)

(52) U.S. Cl. ..... 313/477 R; 220/2.1 A; 220/2.3 A

(58) Field of Classification Search ..... 313/477 R; 220/2.1 A, 2.3 A
See application file for complete search history.

(56) References Cited

U.S. PATENT DOCUMENTS 5,155,411 A * 10/1992 Swank et al. ..... 313/477 R
6,819,039 B2 * 11/2004 Fujihara et al. ..... 313/477 R
2002/0185959 A1 * 12/2002 Sugawara et al. ..... 313/477 R

OTHER PUBLICATIONS

U.S. Appl. No. 09/587,102, filed Jun. 2, 2000 for Slim Tube Funnel Design With Improved Funnel. Inventors : Opesko, Stephen T. et al.

* cited by examiner

*Primary Examiner*—Karabi Guharay
(74) *Attorney, Agent, or Firm*—Birch, Stewart, Kolasch & Birch, LLP

(57) ABSTRACT

The present invention relates to a cathode ray tube having a glass structure which minimizes a stress according to a cathode ray tube of slim type, having a panel with a phosphor screen formed on the inner surface thereof. A funnel, which is joined to the panel, has a body portion, a yoke portion and a neck portion, and a thickness projection is provided in the body portion of the funnel between a seal line plane and the neck portion of the funnel.

14 Claims, 7 Drawing Sheets

Fig. 1 CONVENTIONAL ART
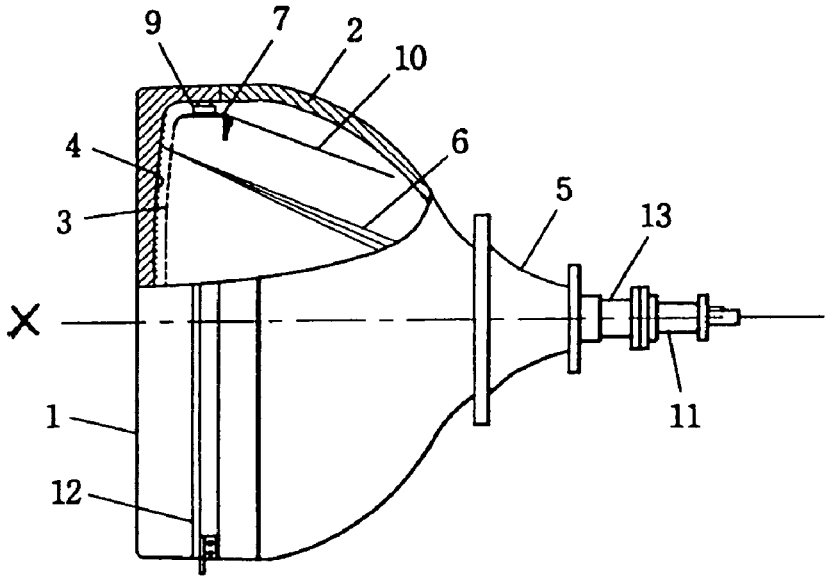
Fig. 2a CONVENTIONAL ART
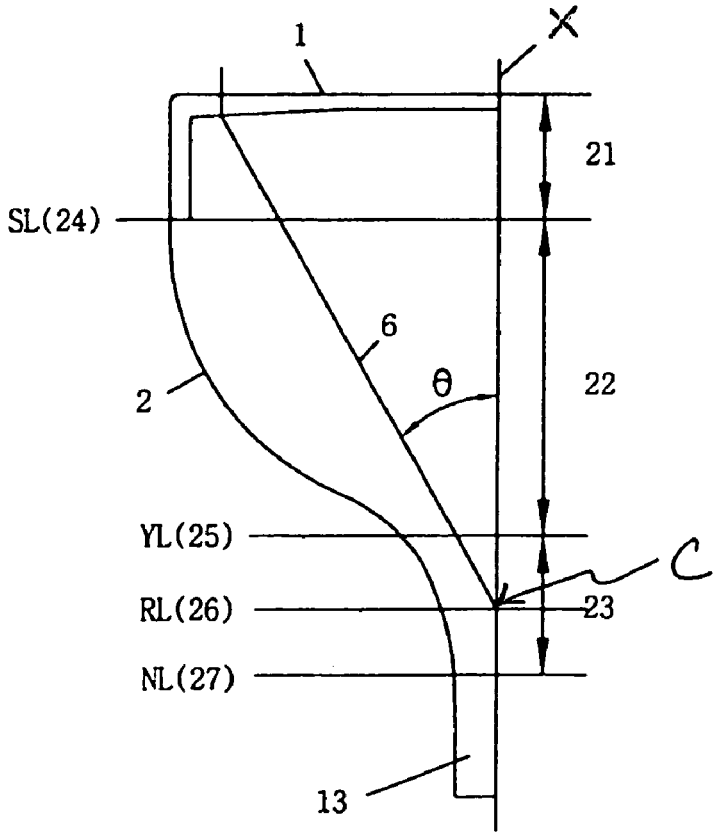

GLASS STRUCTURE OF CATHODE RAY TUBE

TECHNICAL FIELD

The present invention relates to a cathode ray tube and more specifically to a cathode ray tube having a glass structure which minimize a stress due to a cathode ray tube of slim type.

BACKGROUND OF THE INVENTION

FIG. 1 shows a schematic diagram illustrating the structure of a general color cathode ray tube. As shown in FIG. 1, the color cathode ray tube generally includes a glass envelope having a shape of bulb and being comprised of a faceplate panel 1 to which explosion prevention means is fixed, a tubular neck, and a funnel 2 connecting the panel 1 and the neck. A phosphor screen 4 is formed on the inner surface of the faceplate panel 1. The phosphor screen 4 is B130 coated by phosphor materials of R, G, and B.

A multi-apertured color selection electrode, i.e., shadow mask 3 is mounted to the panel 1. The shadow mask 3 is hold by a peripheral frame 9. An electron gun 11 is mounted within the neck to generate and direct electron beams 6 along paths through the mask to the panel 1.

The cathode ray tube further comprises an inner shield 10 for shielding the tube from external geomagnetism. The inner shield 10 is joined to the frame 9. Further, a spring 7 for combining the frame 9 and the funnel 2 is joined to the frame 9.

FIG. 2*a* shows a cross-sectional view illustrating the conventional cathode ray tube and FIG. 2*b* shows a cross-sectional view illustrating a cathode ray tube of slim type.

As shown in FIGS. 2*a* and 2*b*, the cathode ray tube has a panel portion 21, a body portion of the funnel 22, a yoke portion of the funnel 23 and a neck portion. Hereinafter, the following parameters are used to describe the prior art and the present invention.

The panel portion 21 is a portion from an outer surface of the panel 1 to a seal line plane (SL) 24. The body portion of the funnel 22 is a portion from the SL 24 to a yoke line plane (YL) 25. The yoke portion of the funnel 23 is a portion from the YL 25 to a neck line plane (NL) 27.

Herein, deflection axis X means extension line of the central axis of the electron gun through the screen.

Deflection center C-means a point on the deflection axis X such that deflection angle made with the deflection axis X and a line which connects the deflection center C and a diagonal end of the effective screen becomes maximum.

Deflection center C means a point on the deflection axis X such that deflection angle made with the deflection axis X and a line which connects the deflection center C and a diagonal end of the effective screen becomes maximum.

Deflection angle means an angle made with the deflection axis X and a line connecting the deflection center C and a diagonal end of the effective screen.

The seal line plane SL is a vertical plane which is perpendicular to the deflection axis X and includes a closed line through which the panel and the funnel is sealed together.

The yoke line plane YL means a vertical plane which is perpendicular to the deflection axis X and includes a boundary line between the body and yoke portions of the funnel.

The neck line plane NL means a vertical plane which is perpendicular to the deflection axis X and includes a closed line through which the neck portion and the funnel is sealed together.

A reference line plane RL means a vertical plane which is perpendicular to the deflection axis X and includes the deflection center C.

In general, the volume and weight of the cathode ray tube is lager than the other display apparatuses. Therefore, the conventional cathode ray tube has been changed into slim type.

It is preferable to reduce the body portion of the funnel 22 to make the cathode ray tube to be slim type as shown in FIG. 2*b*. However, the reduction of the body portion of the funnel 22 has the following problem.

The electron beams 6 of the cathode ray tube of slim type have to be scanned with larger deflection angle (θ-θ') than the conventional one.

For example, the conventional cathode ray tube has the deflection angle which is less than 100°. On the other hand, the cathode ray tube of slim type has the deflection angle of larger than 100°. As the depth of the cathode ray tube decreases, the electron gun becomes closer to the panel 1. Therefore, larger deflection angle (θ') is required.

Moreover, the reduction of depth of the cathode ray tube is one of causes increasing the stress of the panel glass. If the stress increases, the strength of structure of cathode ray tube becomes weak such that the cathode ray tube is easily exploded by external shock. The portion which is most weak against external shock is the portion adjacent to YL 25.

Therefore, the funnel 2 is easily destroyed during impact test. The cathode ray tube having the minimum weight is economical, but it must satisfies the stress and stability at the same time.

According to Korean Laid-open Patent Publication No. 2001-110113, the depth of the body potion of the funnel was designed to be small to reduce the weight of the cathode ray tube, and a rib was fixed on the body potion of the funnel to reinforce the strength. However, it was not enough that stand against a vacuum stress.

Hereinafter, the manufacturing process of general cathode ray tube is described shortly, and the influence of vacuum and compressive stress during the manufacturing process is described.

The manufacturing process of general cathode ray tube divides into a preceding process and a later process. The preceding process is the process forming the phosphor screen on the inner surface of the faceplate panel, and the later process is made up the following process.

Firstly, a sealing process joining the panel formed the phosphor screen and mounted the shadow mask assembly to the funnel formed a frit at the sealing surface is progressed. After this, an encapsulation process inserting the electron gun into the neck portion of the funnel, making the inside of cathode ray tube vacuous through a ventilating process, injecting a gas, and sealing up the hole for the ventilation and the vacuum is progressed.

Where, the inside of the glass of the cathode ray tube is regulated in the vacuum state of 10-7 Torr at the ventilating process such that the movement of the electron beams become higher.

But, as above, when the inside of the glass is the vacuum state, the tensile stress and compressive force apply to each region the inside and outside of the cathode ray tube.

Namely, the panel 1 and the funnel 2 are received the vacuum stress by an atmospheric pressure, and particularly, the cathode ray tube of slim type receives more the force per the unit area than the general cathode ray tube because the total length of the panel 1 and the funnel 2 get to be small.

FIG. 3 shows a schematic view illustrating the tensile stress and the compressive stress of the inside of a general cathode ray tube in the vacuum state. A dotted line shows the compressive stress and a solid line shows the tensile stress. The tensile stress and compressive stress is important factor in a viewpoint of an impact resistance.

In case that the glass receives the heavy external shock, the glass is cracked, and if the crack is infinitely progressed in a brief instant the glass is completely broken. In other words, the surface of the glass is received the tensile stress which progress the crack, and the glass is completely broken or the surface of the glass is occurred many crack after all.

On the other hand, as the compressive stress preferably prevents from the progress of the crack, as shown in FIG. 3, the center portion of the panel is strong and the corner portion of the panel is weak at the external shock.

Moreover, as the direction of the axis is received the compressive stress and the direction of the diagonal axis is received the tensile stress at the yoke portion of the funnel, its portion may be broken by a little shock.

FIG. 4*a* shows a part of high tensile stress of a general cathode ray tube and FIG. 4*b* shows a part of high tensile stress of a cathode ray tube of slim type.

As shown in FIGS. 4*a* and 4*b*, in case of the general cathode ray tube, a stress concentration is generated at the corner portion ① of the panel 1 and in case of the cathode ray tube of slim type, a stress concentration is generated at the YL portion ③ adjoined the body portion of funnel and the yoke portion of the funnel.

FIG. 5 shows a simulating view illustrating the occurrence of a tensile stress of a YL portion inside according to making into a slim and a decrease of an over-all length. As shown in FIG. 5, the tensile stress is concentrated upon the YL portion 25.

To solve above problems, the following methods may are considered, but exist the following problems.

The method increasing the thickness of the glass may be considered. However, this method has the problem which the electron beams are bumped against the inner surface of the yoke portion the image and a shadow is cast on a screen.

And the method attaching a reinforcing band to the sidewall portion of the panel to prevent the cathode ray tube from being exploded by external shock may be considered, but the effect is weak in the cathode ray tube of slim type.

Moreover, the methods using a tempered glass applied heat treatment or adhering a film on the surface of the panel to increase a physical strength may are considered. However, these methods are applied to the panel and can not applied to the glass.

Therefore, the characteristic of the electron gun and the deflection yoke should be improved and particularly, the problem of a high strength of the glass should be solved before everything else to embody the cathode ray tube of slim type.

SUMMARY OF THE INVENTION

An object of the present invention is to provide a glass structure of a cathode ray tube reducing the vacuum stress.

Another object of the present invention is to provide a cathode ray tube having a panel structure which cut down on expenses and weight.

To accomplish the objects of the present invention, a cathode ray tube according to the present invention comprise: a panel having phosphor screen formed on the inner surface thereof; a funnel joined to the panel and having a body portion, a yoke portion and a neck portion; and an electron gun mounted to the neck portion of said funnel; wherein a projection is provided between a seal line plane and the neck portion of the funnel.

BRIEF DESCRIPTION OF THE DRAWINGS

FIG. 1 shows a schematic diagram illustrating the structure of a general cathode ray tube.

FIG. 2*a* shows a cross-sectional view illustrating the conventional cathode ray tube.

DETAILED DESCRIPTION OF THE INVENTION

Preferred embodiments of the present invention will be described in a more detailed manner with reference to the drawings.

Figure 6:
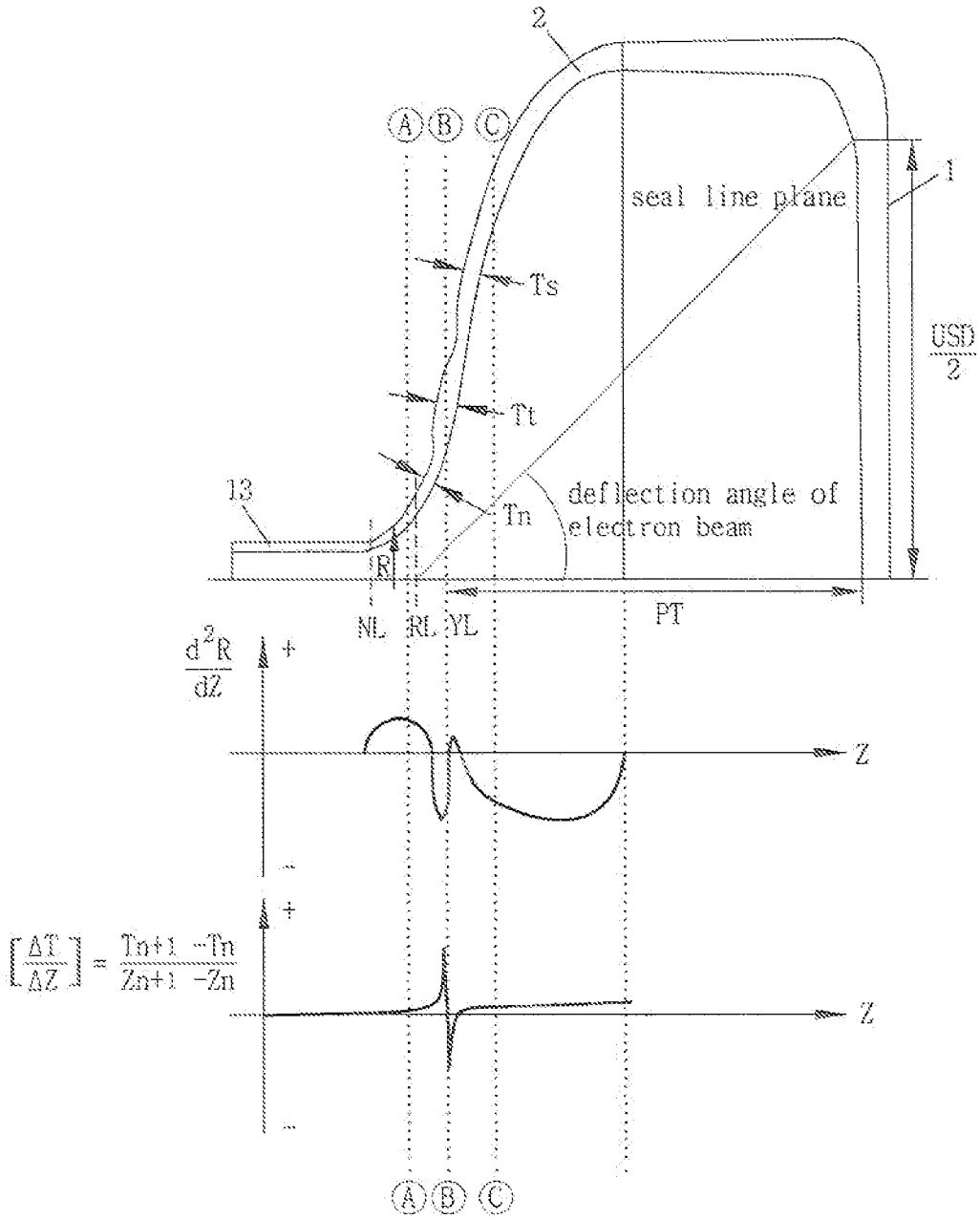
FIG. 6 shows a cross-sectional view of cathode ray tube of slim type and a view graphing data of second order differential according to the present invention.

FIG. 6 shows a cross-sectional view of cathode ray tube of slim type and a view graphing data of second order differential according to the present invention.

In FIG. 6, Z is the coordinate of a tubular axis and R is a distance from the tubular axis to a surface of the funnel.

$d^2R/dz$ is a mathematics equation of second order differential which differentiates R with respect to Z. When $d^2R/dz$ is larger than 0, the surface of the funnel becomes a concave shape in the direction of the tubular axis. When $d^2R/dz$ is no larger than 0, the surface of the funnel becomes a convex shape in the opposite direction of the tubular axis.

When $d^2R/dz$ is equal to 0, this point means a point of inflection.

Figure 2B:
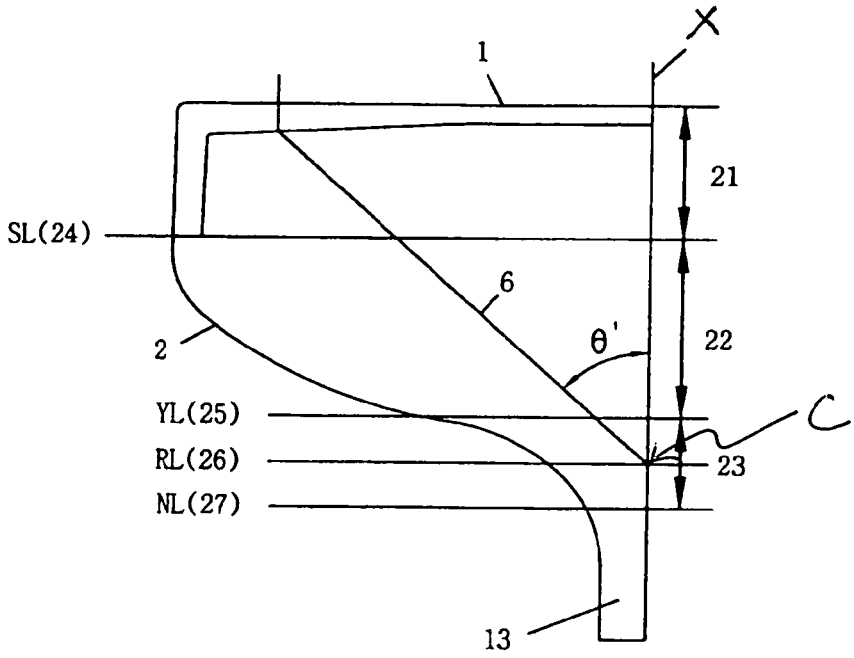
FIG. 2*b* shows a cross-sectional view illustrating a cathode ray tube of slim type.
Figure 3:
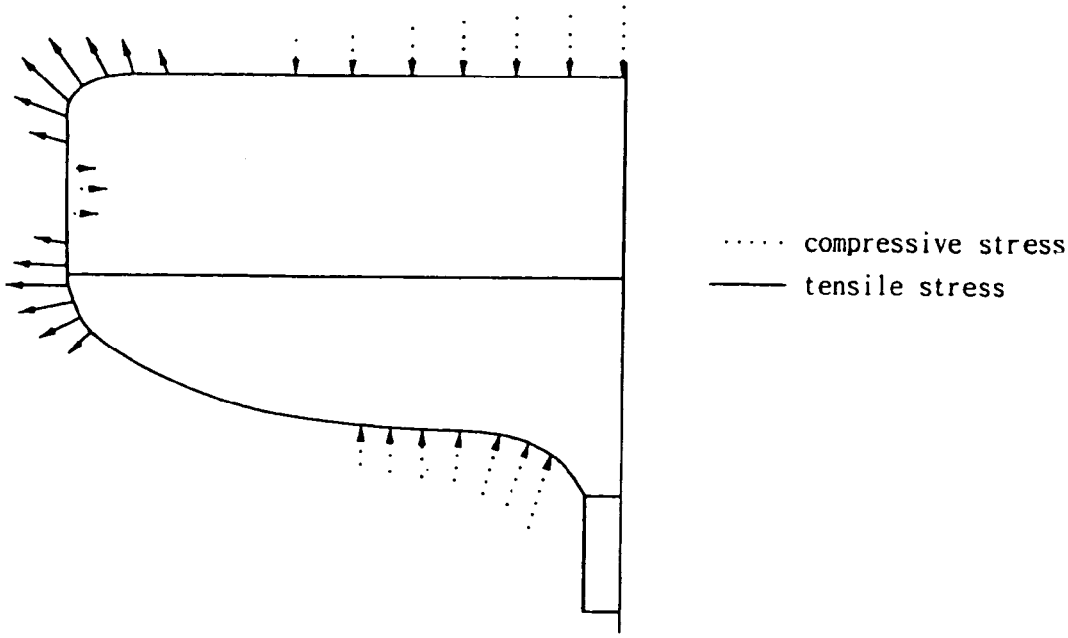
Fig. 3 CONVENTIONAL ART
FIG. 3 shows a schematic view illustrating the tensile stress and the compressive stress of the inside of a general cathode ray tube.
Figure 4A:
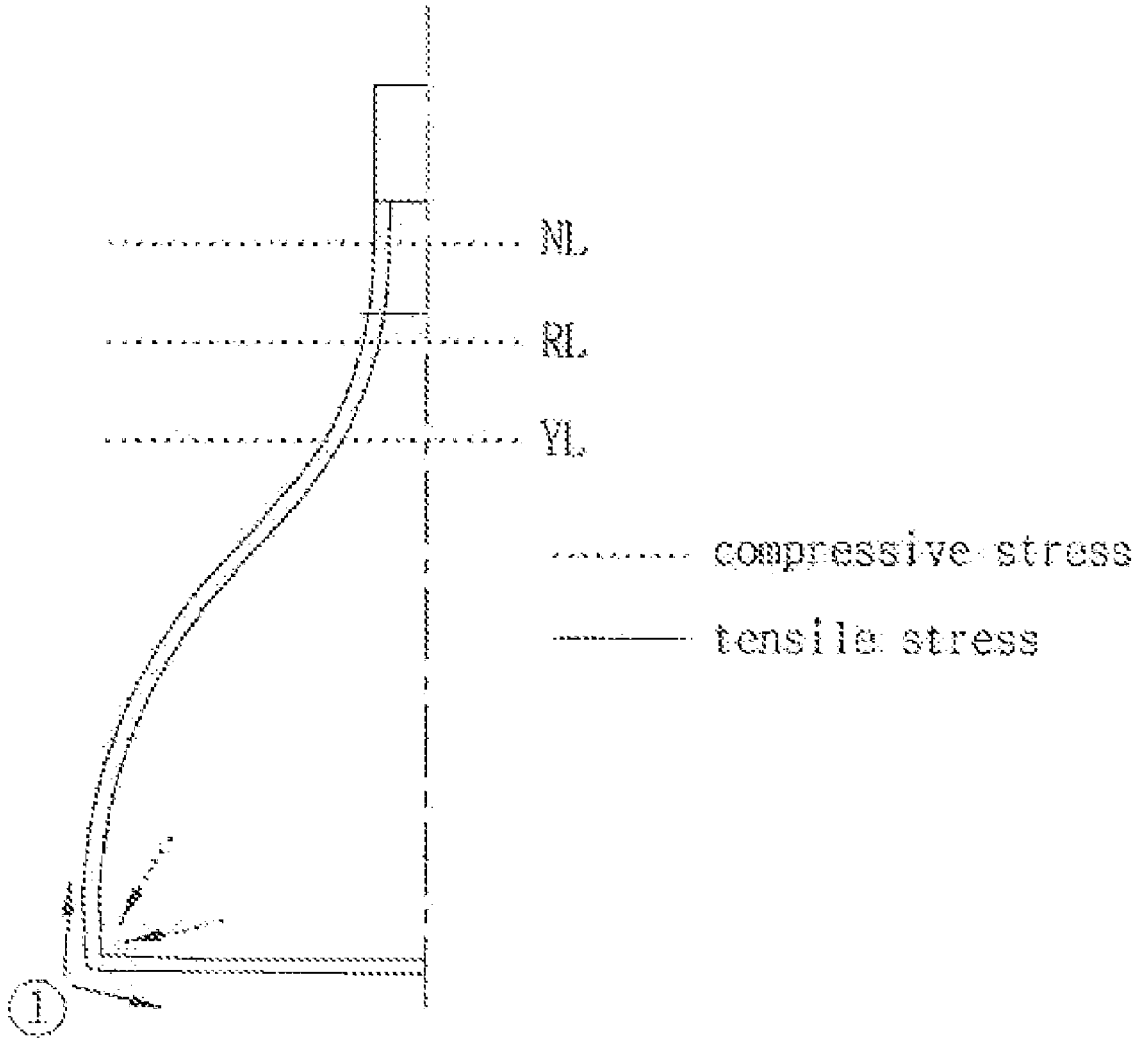
FIG. 4*a* shows a part of high tensile stress of a general cathode ray tube.
Figure 4B:
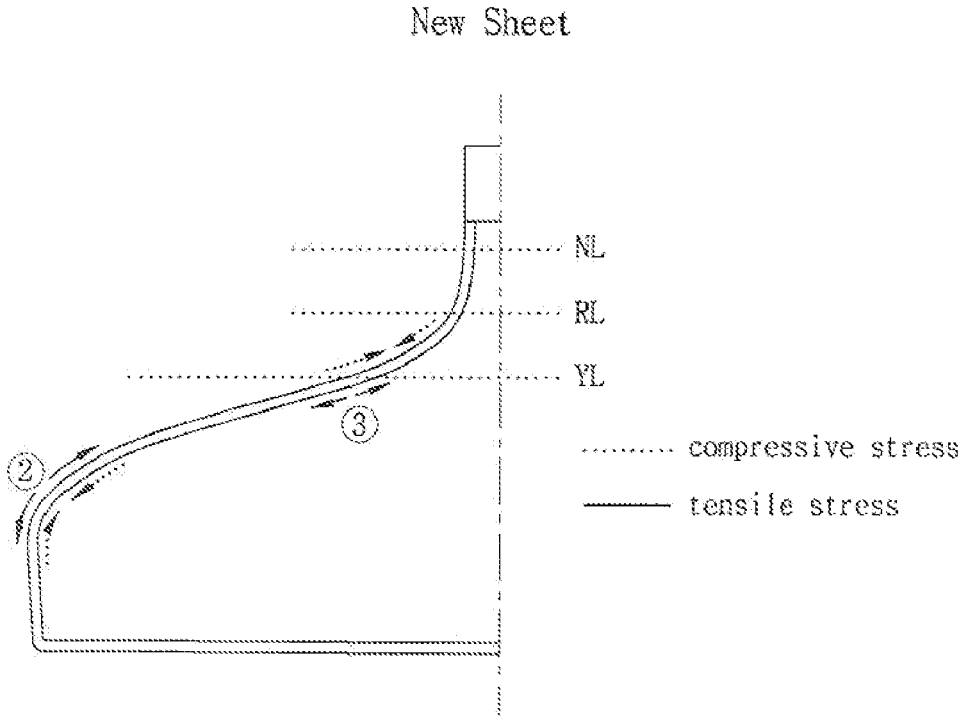
FIG. 4*b* shows a part of high tensile stress of a cathode ray tube of slim type.
Figure 5:
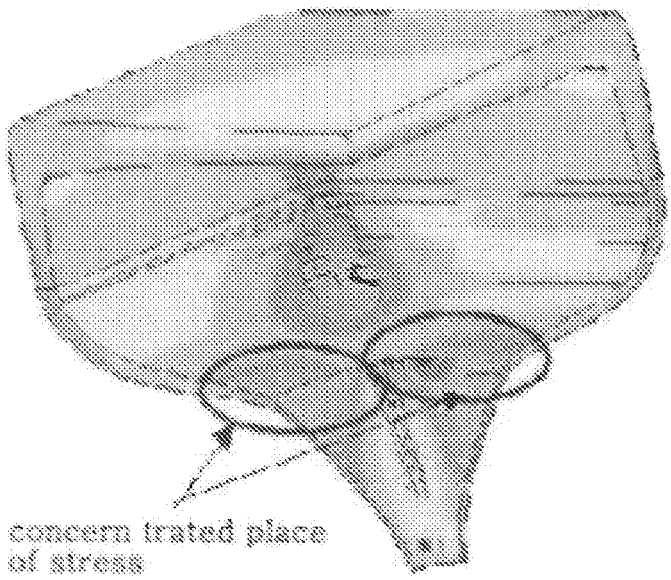
FIG. 5 shows a simulating view illustrating the occurrence of a tensile stress of a YL portion inside according to making into a slim and a decrease of an over-all length.

As shown FIG. 4*b*, a stress is concentrated at a portion ③ of a yoke line plane 25 which includes a boundary line between the body 22 and yoke 23 portions of the funnel. Therefore, the thickness of the portion ③ of the yoke line plane 25 is increased to decrease the tensile stress by a vacuum exhaustion.

furthermore, as a consequence of being not changed the inner surface and being changed the outer surface of the funnel 2, the electron beams may be prevented from bumping against the inner surface of the funnel 2. At the same time, as a consequence of having a projection, the cathode ray tube structure of slim type may be improve.

Where, the projection means a thick portion at the surface of the panel and funnel.

And, the projection is formed on the boundary line between the body and yoke portions of the funnel.

Furthermore, a thickness of the funnel except the projection becomes gradually greater from the neck portion to the seal line plane.

As shown in FIG. 6, the point of inflection is no less than or equal to two points. Where both sides of the projection have the point of inflection at the outer surface of the funnel, the variation of the cross-sectional thickness occurs.

A variation rate of a cross-sectional thickness according to a variation rate of a unit length, $\Delta T/\Delta Z$, satisfies the equation 1.

$$\Delta T/\Delta Z=(Tn+1-Tn)/(Zn+1-Zn) \quad \text{Equation. 1}$$

Referring to the lower end of FIG. 6, the maximum and minimum values of the above variation rate exist in YL 25.

At least the projection more than one should be formed on the YL portion of the funnel to satisfy the above $d^2R/dZ$ and $\Delta T/\Delta Z$. It means that the increase and decrease of cross-sectional thickness of the funnel are at least more than a position. The tensile stress of the YL portion is reduced by the increase and decrease of cross-sectional thickness of the funnel.

A maximum thickness Tmax and a minimum thickness Tmin of a cross section of the projection satisfies the equation 2.

$$1.5 \leqq T\max/T\min \leqq 4.0 \quad \text{Equation. 2}$$

When A is a plane which is 30 mm apart from yoke line plane B toward neck portion, C is a plane which is 40 mm apart from the yoke line plane B toward the screen, and Tn is a thickness of said funnel at a position between A and the yoke line plane B, Tt is thickness of said funnel at the yoke line plane B, and Ts is a thickness of said funnel at a position between the yoke line plane B and the plane C, the variables satisfy the equation 3.

$$Tt/Ts \geqq 0.9,\ Tt/Tn \geqq 1.0,\ Tt \geqq 0.7\ \text{mm} \quad \text{Equation. 3}$$

Generally, a thickness of the funnel of the conventional cathode ray tube becomes gradually greater from the neck portion to the seal line plane. Namely, the cross-sectional thickness of the body portion is 9.2 mm, the cross-sectional thickness of the YL portion is 5 to 6 mm and the cross-sectional thickness of the neck portion is 2.4 to 3 mm.

According to the embodiment of the present invention, the cross-sectional thickness of the YL portion is no less than or equal to 7.0 mm and 90% of the body portion. When Tt/Ts is less than 0.9 or Tt/Tn is less than 1.0, the YL portion stand not the tensile stress.

The panel and funnel according to the embodiment of the present invention satisfy the equation 4.

$$USD/PT \geqq 2.5 \quad \text{Equation. 4}$$

where, USD is a diagonal length of an effective screen of the panel, and PT is a distance between a central point of an inner surface of said panel and the yoke line plane.

Furthermore, a cross section of the neck portion according to the present invention is shaped non circular and a deflection angle of the electron beams is no less than or equal to 100°.

Figure 7:
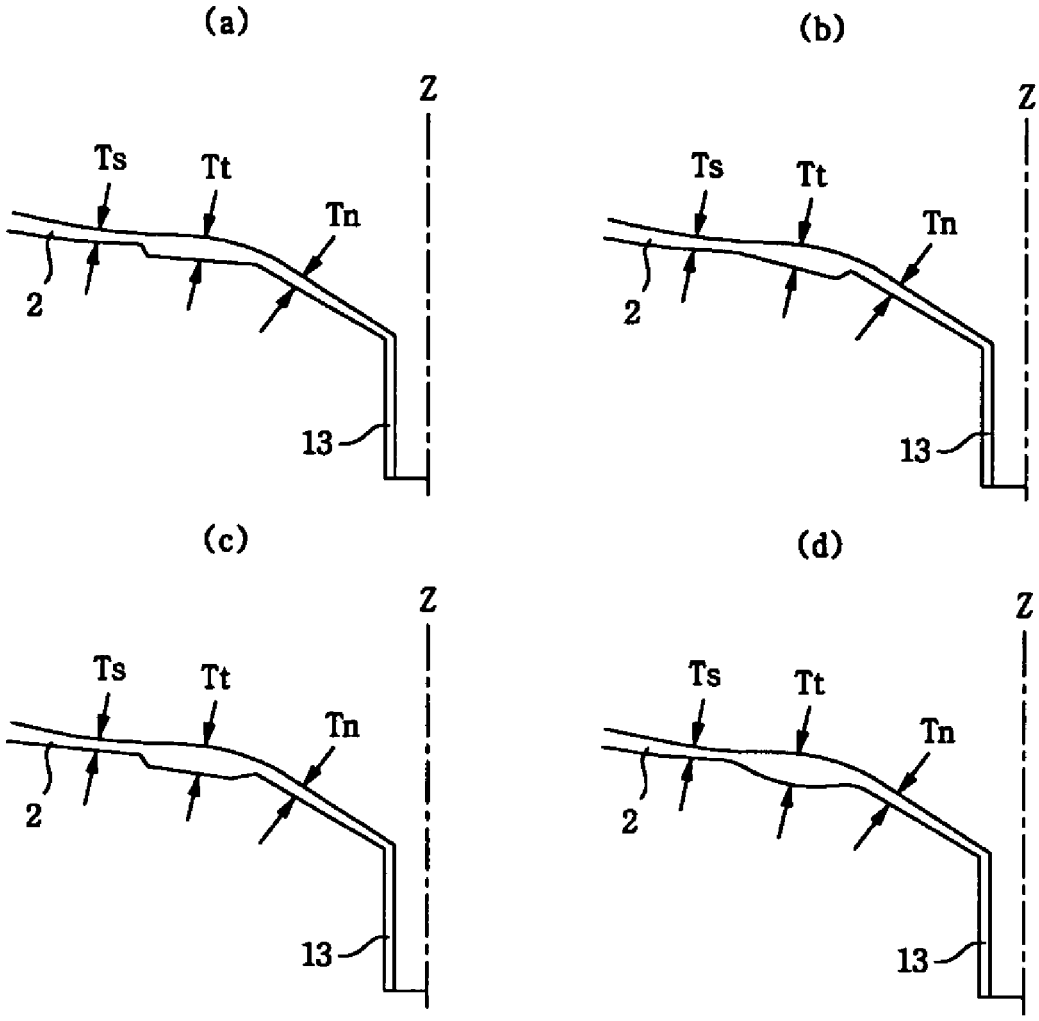
FIG. 7 shows embodiments according to the present invention.

FIG. 7 shows embodiments according to the present invention.

As shown in FIG. 7, (a) and (b) have one side of the projection formed into a stair of a gentle slope and the other side of the projection formed into a stair of a rapid slope at the outer surface of the funnel. (c) and (d) have both sides of the projection formed into a stair of a similar slope.

(a) and (d) are the shapes which have a good insertion of compensating supporter fixing the deflection yoke. These shapes are possible to increase the thickness of the projection as a whole by the good insertion of the compensating supporter, therefore the cathode ray tube having these shapes decreases the tensile stress. However, the increase of thickness increases the weight of the cathode ray tube as a whole.

(b) and (c) have a bad insertion of compensating supporter, namely, these shapes may be increased the thickness of the other parts excepted inserting position of compensating supporter.

Each tensile stress applied to (b) and (c) shapes is smaller than each that applied to (a) and (d) shapes, and each weight of (b) and (c) shapes is smaller than each that of (a) and (d) shapes.

Figure 8:
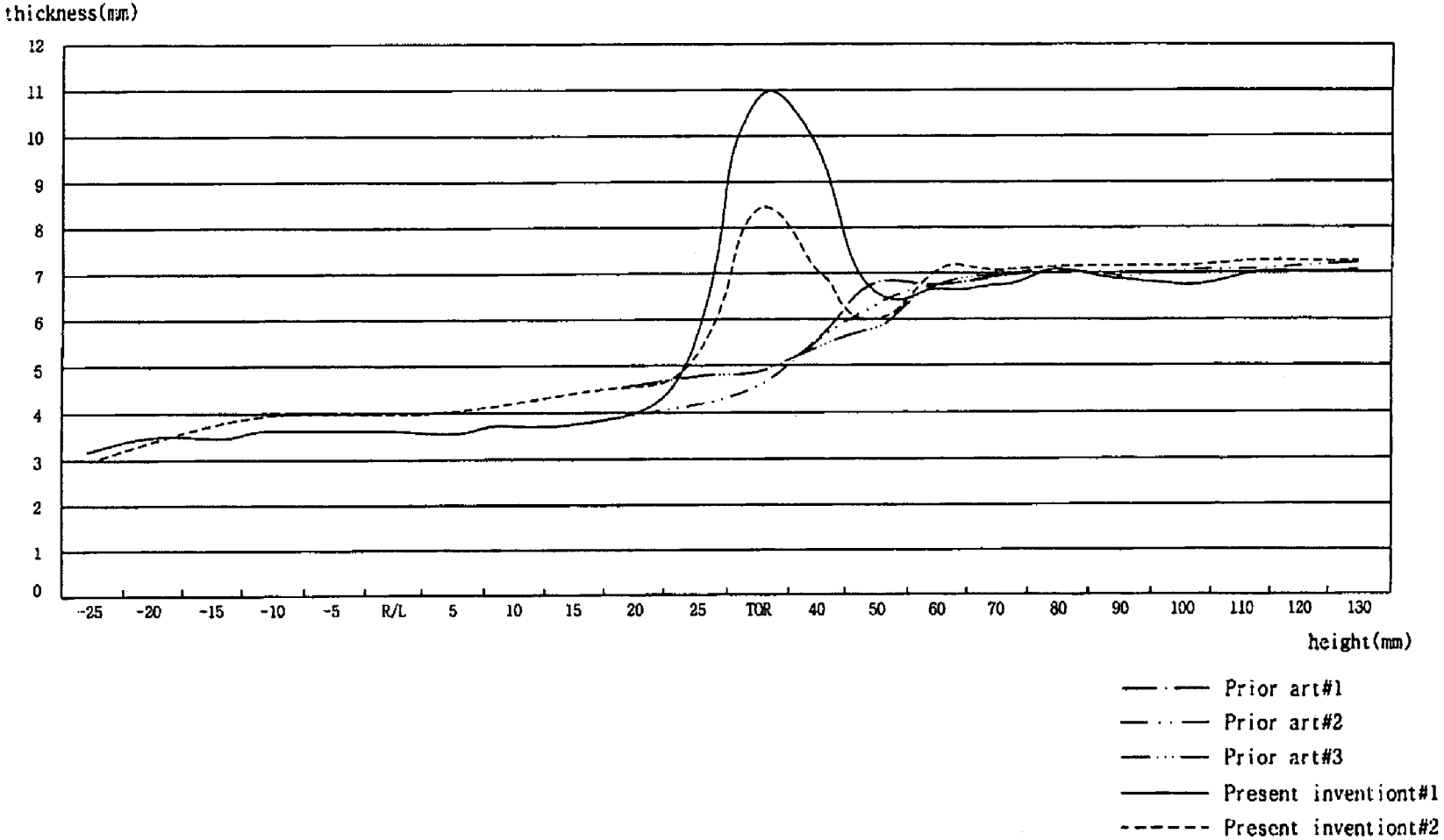
FIG. 8 shows a graph comparing a cross-sectional thickness according to the conventional technique with one according to the present invention.

FIG. 8 shows a graph comparing a cross-sectional thickness according to the conventional technique with one according to the present invention.

In FIG. 8, the left side means the neck portion of the funnel and the right side means the body portion of the funnel.

As shown in FIG. 8, the prior arts show the gradually increase of the cross-sectional thickness and the embodiments of the present invention show the cross-sectional thickness of the projection which the increasing rate is relatively large. Furthermore, the cross-sectional thickness of the projection exists in large positions than the cross-sectional thickness of the body portion of the funnel.

INDUSTRIAL APPLICABILITY

According to the present invention, the cathode ray tube of slim type has the glass reducing the vacuum stress and prevents the crack and explosion from the external shock by forming the projection on the YL portion.

Furthermore, the cathode ray tube has a panel structure which cut down on expenses and weight by forming the projection on the YL portion.

The invention claimed is:

1. A cathode ray tube comprising:

a panel having a phosphor screen formed on the inner surface thereof;

a funnel joined to the panel at a seal line plane and having a body portion, a yoke portion, a yoke line plane, and a neck portion; and an electron gun mounted to the neck portion of said funnel, wherein a thickness projection in the body portion of the funnel is provided on the yoke line plane and said panel and said funnel satisfy:

$$USD/PT \geqq 2.5$$

wherein USD is a diagonal length of an effective screen of the panel, and PT is a distance between a central point of an inner surface of said panel and the yoke line plane.

2. The cathode ray tube of claim 1, wherein a maximum thickness Tmax and a minimum thickness Tmin of a cross section of said thickness projection satisfies:

$$1.5 \leqq T\max/T\min \leqq 4.0.$$

3. The cathode ray tube of claim 1, wherein a thickness of said thickness projection is greater than a thickness of the adjacent body portion of the funnel.

4. The cathode ray tube of claim 3, wherein said thickness projection at an outer surface of said funnel is provided with stairs at the ends thereof.

5. The cathode ray tube of claim 3, wherein said thickness projection at an outer surface of said funnel is provided with ends having curvature.

6. The cathode ray tube of claim 1, wherein a thickness of said funnel except the thickness projection becomes gradually greater from the neck portion to the seal line plane.

7. The cathode ray tube of claim 1, wherein a deflecting angle of the electron beams is no less than or equal to 100°.

8. The cathode ray tube of claim 7, wherein a cross section of the neck portion has a non-circular shape.

9. The cathode ray tube of claim 1, wherein a cross section of the neck portion has a non-circular shape.

10. A cathode ray tube comprising:

a panel having a phosphor screen formed on the inner surface thereof;

a funnel joined to the panel at a seal line plane and having a body portion, a yoke portion, a yoke line plane, and a neck portion; and an electron gun mounted to the neck portion of said funnel, wherein a thickness projection in the body portion of the funnel is provided between the seal line plane and the neck portion of the funnel extending on both sides of the yoke line plane, and wherein said panel and said funnel satisfy:

$$USD/PT \geqq 2.5$$

wherein USD is a diagonal length of an effective screen of the panel, and PT is a distance between a central point of an inner surface of said panel and the yoke line plane.

11. The cathode ray tube of claim 10, wherein a deflection angle of the electron beams is no less than or equal to 100°.

12. The cathode ray tube of claim 10, wherein a cross section of the neck portion has a non-circular shape.

13. The cathode ray tube of claim 11, wherein a cross section of the neck portion has a non-circular shape.

14. A cathode ray tube comprising:

a panel having a phosphor screen formed on the inner surface thereof;

a funnel joined to the panel at a seal line plane and having a body portion, a yoke portion, a yoke line plane, and a neck portion; and an electron gun mounted to the neck portion of said funnel, wherein a thickness projection in the body portion of the funnel is provided between the seal line plane and the neck portion of the funnel extending on both sides of the yoke line plane, and wherein said funnel satisfies:

$$Tt/Ts \geqq 0.9,\ Tt/Tn \geqq 1.0,\ Tt \geqq 0.7\ \text{mm}$$

wherein A is a plane which is 30 mm apart from the yoke line plane to neck portion, C is a plane which is 40 mm apart from the yoke line plane to the screen, and Tn is a thickness of said funnel at a position between A and the yoke line plane, Tt is a thickness of said funnel at the yoke line plane, and Ts is a thickness of said funnel at a position between the yoke line plane and C.

* * * * *